United States Patent [19]

Mutschler

[11] 4,017,655

[45] Apr. 12, 1977

[54] SELECTIVELY SEPARABLE STRIP ASSEMBLY

[75] Inventor: Ulrich F. Mutschler, Marly-le-Roi, France

[73] Assignee: I E R Impression Enregistrement des Resultats, France

[22] Filed: Feb. 11, 1976

[21] Appl. No.: 657,206

[30] Foreign Application Priority Data

Mar. 26, 1975 France ..... 75.09535

[52] U.S. Cl. ..... 428/43; 428/56; 428/137; 428/906; 428/914

[51] Int. Cl.[2] ..... B65D 65/28; G09F 3/00

[58] Field of Search ..... 428/43, 54, 55, 56, 428/131, 134, 136, 137, 155, 138, 906, 914

[56] References Cited

UNITED STATES PATENTS

| | | | |
|---|---|---|---|
| 386,618 | 7/1888 | Wheeler | 428/43 |
| 405,412 | 6/1889 | Hicks | 428/43 |
| 1,174,069 | 3/1916 | Hosford | 428/43 |
| 1,774,497 | 8/1930 | Wandel | 428/43 |
| 1,776,417 | 5/1930 | Lake | 428/43 |
| 3,547,752 | 12/1970 | Janssen | 428/43 |

*Primary Examiner*—William J. Van Balen

*Attorney, Agent, or Firm*—Roylance, Abrams, Berdo & Kaul

[57] ABSTRACT

A strip assembly comprising an elongated support strip, either rolled or folded, and at least one second strip superimposed on the support strip, the second strip having transverse slits formed therein at equal intervals, each slit extending only partly across the central portion of the second strip, leaving edge portions of the second strip connected and leaving substantially the entire support strip connected. By severing the edge portions, the second strip can be separated into individual sheets, leaving the support strip attached in the central region. The second strip can be provided with a coating of reproduction material on the back surface thereof so that data can be printed on the sheets of both strips, forming a plurality of individual receipt slips and a continuous information-bearing strip usable for accounting purposes. The support strip can be provided with holes near the ends of the slits to reduce the criticality of location of the severing operation. The second strip can comprise two or more layers to form two or more separable pages at each cut.

5 Claims, 4 Drawing Figures

SELECTIVELY SEPARABLE STRIP ASSEMBLY

This invention relates to a continuous strip assembly for imprinting and selective separation.

In various circumstances such as, for example, gasoline stations, a mechanical device is used for printing a charge slip for the amount of a sale or other transaction, the slip having two or more parts with carbon paper or other reproduction material therein. After the data is imprinted, the slips are separated and one copy is usually given to the customer while at least one other copy is used for accounting purposes. Frequently, one copy is provided for the customer, one for the sales facility and at least one other copy for a credit organization or the like.

Generally, such documents have been provided individually, i.e., each assembly is a separate, independently handled booklet with the pages being connected together at one end and being separable along a perforated line.

An object of the present invention is to provide a continuous assembly having a support strip and a second strip which, after imprinting, can be separated into discrete documents which are separated from the rest of the strip, the support being retained with the information imprinted thereon for subsequent handling by an accounting system.

Briefly described, the invention includes an elongated support strip, and a second strip superimposed on the support strip, the second strip being substantially coextensive with the support strip and having means defining a plurality of transverse slits extending partially across the second strip at substantially equal longitudinal intervals, the assembly being severable along transverse lines aligned with and transversely offset from the slits to completely separate the second strip into individual sheets while leaving corresponding portions of the support strip interconnected at the regions adjacent the slits. Advantageously, the slits extend transversely across the midportion of the second strip and terminate at points spaced inwardly from the longitudinal edges of the support strip. The assembly can include a plurality of such second strips, and the support strip can include means defining first and second holes aligned with the ends of the slits.

In order that the manner in which the foregoing and other objects are attained in accordance with the invention can be understood in detail, a particularly advantageous embodiment thereof will be described with reference to the accompanying drawings, which form a part of this specification, and wherein.

Figure 1:
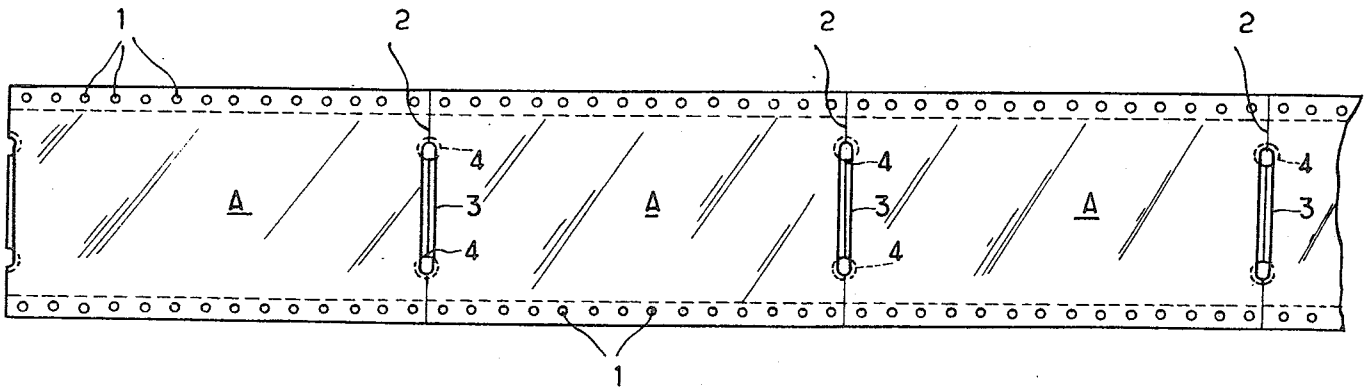
FIG. 1 is a plan view of a portion of an assembly according to the invention.
Figure 2:
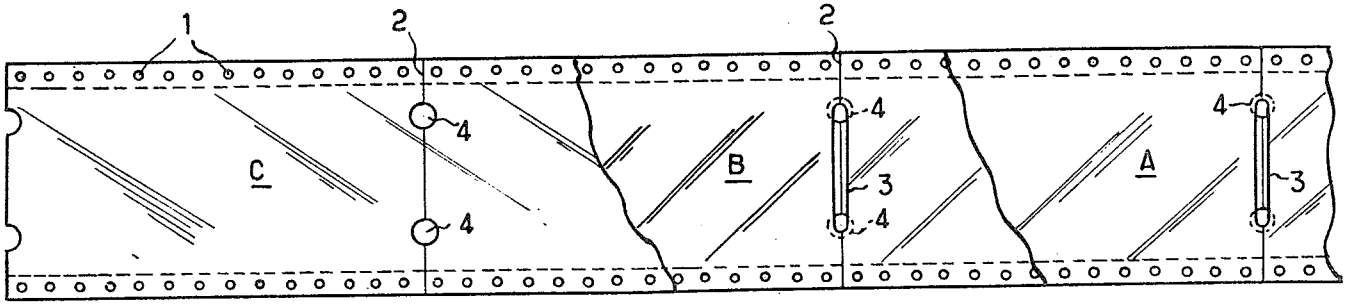
FIG. 2 is a plan view of the assembly of FIG. 1 with portions of selected strips removed.

Referring first to FIGS. 1 and 2, it will be seen that the assembly comprises a plurality of superimposed layers, three being used in the present example, these being identified as layers A, B and C. Layer C constitutes a support strip which is intended to remain in substantially continuous connected form, while layers A and B constitute strips which are to be separated into individual pages after imprinting, layer A being the top sheet in the assembly. Sheets A and B can be coated at appropriate places on their back surfaces with reproduction material of a conventional type, either carbon or carbonless, as is well known in the art. By this technique, all three layers of any portion of the assembly can be simultaneously imprinted with desired data. The sheets are substantially coextensive and are provided, in the example shown, with a plurality of Carol-type perforations 1 to permit driving of the strip through an associated imprinting device by conventional means.

Layers A and B are designed to be cut transversely or crosswise at regular intervals along lines 2 to form individual discrete documents which can be separated from the rest of the strip, leaving layer C. To permit this separation, sheets A and B are provided with an elongated precut slit 3 which extends transversely across a portion of sheets A and B aligned with lines 2, slits 3 extending across approximately half of the width of the entire strip. Strip C is provided with pairs of holes 4 at the ends of slits 3.

Figure 3:
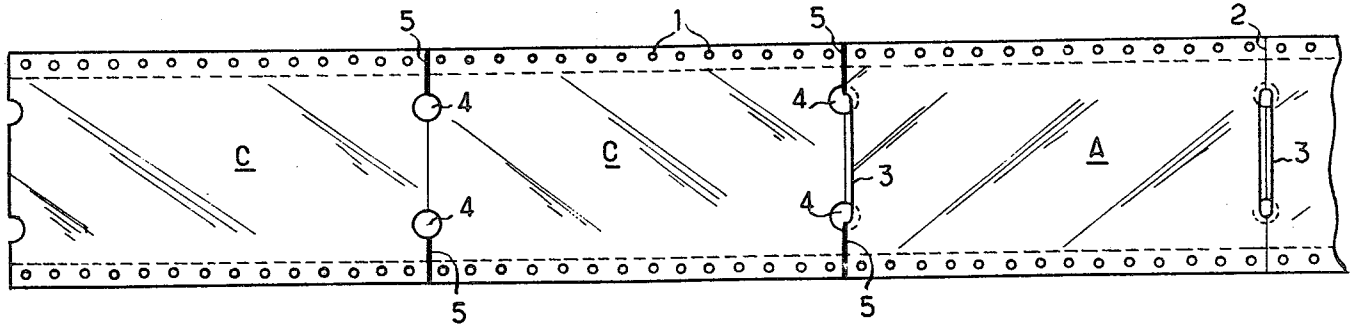
FIG. 3 is a plan view of the assembly of FIG. 1 after separation of sheet portions.
Figure 4:
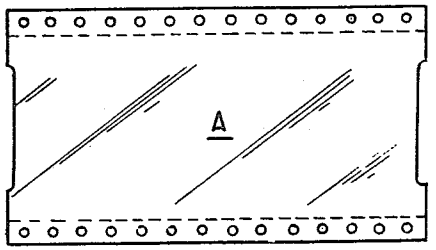
FIG. 4 is a plan view of one sheet separated from the assembly of FIG. 3.

In order to separate individual pages of strips A and B from strip C, it is only necessary to cut all the way through all three layers along those portions of line 2 which are between the ends of slit 3 and the longitudinal edges of the strip as indicated at 5 in FIG. 3. The partial cuts 5 can be made simply and automatically at the exit end of the printer by means of a suitable cutting blade having its central portion removed, the removed portion being approximately equal in length, or slightly shorter than, the length of slit 3. In this connection, it will be noted that the provision of holes 4 in sheet C makes it possible to avoid defects by introducing a tolerance area so that the dimension for alignment of the cutting device does not have to be precise. After cuts 5 are made, sheets A and B are completely separated from strip C, a typical sheet A being illustrated in FIG. 4. These sheets thus constitute discrete independent documents which can be delivered to the user or otherwise employed to serve as records.

The continuous strip assembly can be stored, before use, in either a roll or accordion form and the resulting strip C, after sheets A and B have been removed therefrom, can similarly be stored in roll or accordion form, as convenient.

While one advantageous embodiment has been chosen to illustrate the invention, it will be understood by those skilled in the art that various changes and modifications can be made therein without departing from the scope of the invention as defined in the appended claims.

What is claimed is:

1. A strip assembly for imprinting of data and for subsequent selective separating comprising an elongated support strip; and a second strip superimposed on said support strip, said second strip being substantially coextensive with said support strip and having means defining a plurality of transverse slits extending partially across said second strip at substantially equal longitudinal intervals, said assembly being severable along transverse lines aligned with and transversely offset from said slits to completely separate said second strip into individual sheets while leaving corresponding portions of said support strip interconnected at the regions adjacent said slits.

2. A strip assembly according to claim 1 wherein said slits extend transversely across the midportion of said second strip and terminate at points spaced inwardly from the longitudinal edges of said support strip.

3. A strip assembly according to claim 1 wherein said assembly includes a plurality of said second strips each having said slit defining means.

4. A strip assembly according to claim 3 wherein said slits extend transversely across the midportion of said second strips and terminate at points spaced inwardly from the longitudinal edges thereof.

5. A strip assembly according to claim 4 wherein said support strip includes means defining first and second holes aligned with the ends of said slits.

* * * * *